United States Patent [19]

Lubitzsch

[11] 3,961,396

[45] June 8, 1976

[54] METHOD AND APPARATUS FOR LOOSENING AND SPREADING OF FILAMENT TOWS

[75] Inventor: Wolfgang Lubitzsch, Lubeck-Gr. Steinrade, Germany

[73] Assignee: Schubert & Salzer Maschinenfabrik Aktiengesellschaft, Ingolstadt, Germany

[22] Filed: Feb. 5, 1975

[21] Appl. No.: 547,202

[30] Foreign Application Priority Data

Feb. 5, 1974 Germany ..... 2405473

[52] U.S. Cl. ..... 19/65 T

[51] Int. Cl.[2] ..... D01D 11/02

[58] Field of Search ..... 19/65 T, 66 T; 28/71.3, 28/1.2, 1 CF

[56] References Cited

UNITED STATES PATENTS

| | | | |
|---|---|---|---|
| 2,932,850 | 4/1960 | McNeill et al. | 28/71.3 X |
| 3,408,696 | 11/1968 | Cole | 28/1.2 X |
| 3,491,409 | 1/1970 | Miller | 19/65 T |
| 3,497,920 | 3/1970 | Brownell | 19/65 T |
| 3,611,521 | 10/1971 | Corbiere | 28/71.3 |

*Primary Examiner*—Dorsey Newton

*Attorney, Agent, or Firm*—Bailey & Dority

[57] ABSTRACT

A method and apparatus for loosening and spreading textile tows comprised of bundles of synthetic filaments preparatory to cutting into staple fiber is illustrated including tensioning the tow in a stretching zone while intermittently exerting a force thereon transverse to the direction of movement of the tow.

6 Claims, 2 Drawing Figures

METHOD AND APPARATUS FOR LOOSENING AND SPREADING OF FILAMENT TOWS

BACKGROUND OF THE INVENTION

In handling filament tows as in manufacturing staple fibers it is customary to stretch the tow to separate the filaments that adhere together from each other. Examples of the prior art are illustrated in U.S. Pat. No. 3,253,803, as well as German Patent Application Nos. 1.810.902 and 2.125.711.

The function of the apparatus and method of the invention is to loosen and spread a filament tow continuously and effectively.

SUMMARY OF THE INVENTION

According to the invention this problem is solved by guiding the tow to a stretching zone in which it is plucked in transverse direction to the direction in which it is being stretched. For practical reasons the plucking or application of transverse force occurs intermittently or periodically. The effect of the plucking is enhanced by plucking in a transverse direction in a first phase of the stretching zone and in an opposite transverse direction in a second phase of the stretching zone.

The apparatus for carrying out this procedure is characterized by stretching or tensioning cylinders that are spaced apart from each other and by a plucking device that is positioned between the spaced pairs of stretching cylinders. The plucking device is illustrated as comprising a rotator which has spaced camming or strumming means and the like extending axially outwardly from a flat upper portion of the rotor head. A gentle but yet thorough manipulation of the strands of the tow is accomplished since the plucking means includes combs having tines that are tilted opposite the direction of their rotation.

Accordingly, an important object of the present invention is to provide an apparatus and method for loosening and spreading a filament tow continuously and effectively.

Another important object of the present invention is to provide an apparatus and method for gentle yet thorough plucking of the tensioned strands of a tow in a direction transverse to their movement preparatory to their being cut.

BRIEF DESCRIPTION OF THE DRAWING

Further details of the invention are illustrated in connection with the drawings wherein.

DESCRIPTION OF A PREFERRED EMBODIMENT

Figure 1:
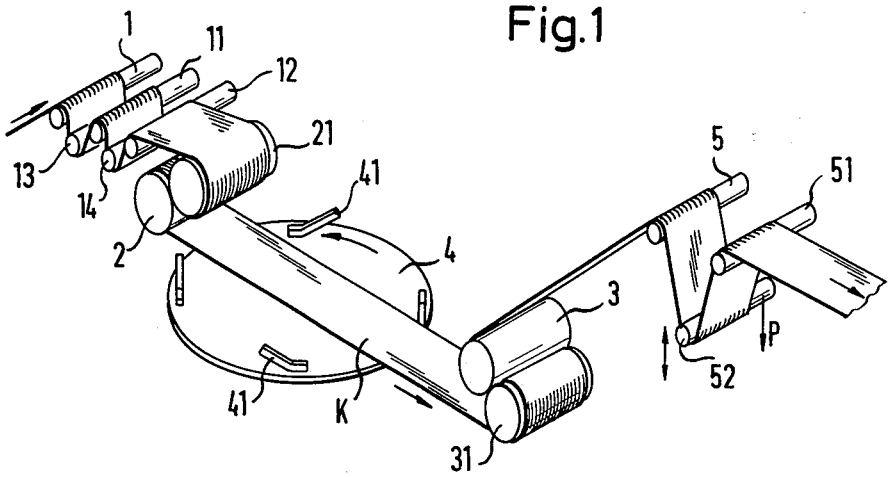
FIG. 1 is a perspective assembly view of the apparatus for loosening and spreading constructed in accordance with the invention.

According to FIG. 1 there are provided a number of guiding rods 1, 11, 12, 13 and 14 positioned where the tow K enters the apparatus. Some of the rods, for example rods 13 and 14, are tilted slightly with respect to the other rods so as to serve as spreader bars and the like and to apply slight pretension to the tow. The guiding rods are followed by two pairs of stretching cylinders or rolls, 2, 21 and 3, 31, that form a tensioning or stretching zone therebetween. The pair of guiding cylinders 3, 31 are driven, the cylinders 2, 21 are adjustable braked. Between the two pairs of stretching cylinders a plucking device in the form of a rotating disc 4 with cams 41 is positioned, consisting of flat inclined profiles. The pair of stretching cylinders 3, 31 is followed by a tensioning and storage device with two stationary rods 5, 51 and a bar or roller that moves in vertical direction 52, tensioning the tow K by exerting a predetermined force P.

Figure 2:
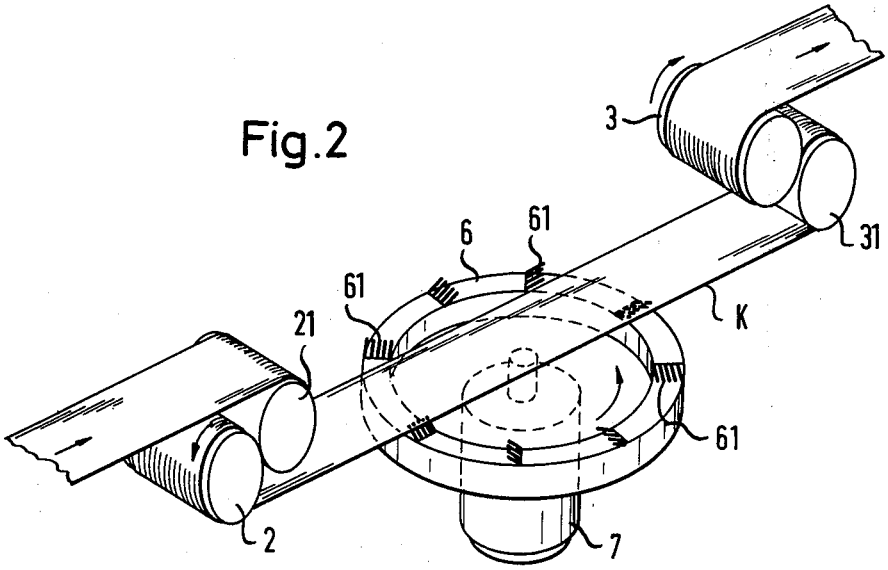
FIG. 2 is an enlarged perspective view further illustrating a modified plucking device between two pairs of stretching cylinders with combs engaging the tow to further illustrate the method and apparatus.

The camming means of the plucking device can be constructed in a variety of desirable configurations. According to FIG. 1 the disc-shaped rotator includes spaced flat profile members 41, whereas the ring-shaped rotator 6 in FIG. 2 illustrates combs 61 as an alternate construction. The flat profiles 41 and the combs 61 located at the head of the rotator, extend outwardly therefrom into engagement with the tow as the head is rotated and are tilted at an angle against the direction of rotation. As shown in FIG. 2, the plucking device is operated by a motor 7, where the speed of rotation is in a predetermined relation to the speed of the tow as it travels through the stretching zone.

During operation the filament tow travels over the guiding rods 1, 11, 12, 13 and 14 which cause a pretensioning of the tow and spread it out by reason of the tilted bars. As the tow travels through the tensioning zone between the pairs of stretching or tensioning cylinders 2, 21 and 3, 31 it is tensioned or stretched lengthwise. While it is being tensioned it is being expanded in a transverse direction by the plucking flat profiles 41 or combs 61 that pass across the tow so as to manipulate the strands thereof with respect to each other. Since the cams are positioned in an arcuate path spaced from each other, the plucking occurs in two phases intermittently each time in an opposite transverse direction. That way the stuck filaments are separated from each other in a dependable manner. Even though the manipulation of the strands is intensive the loosening is being done in such a manner as to avoid breakage of the strands since the flat profiles 41 and combs 61 that form the cams are tilted against the direction of rotation. The intensity of manipulation of the tow can be increased or reduced according to the material. This is made possible as, for example, the plucking device is adjustable in a vertical direction and the tilted angle of the angle profiles 41 and combs 61 can be changed. The plucking occurs only in such a manner that the filaments are not overly attenuated or stretched.

After leaving the tensioning zone the tow K passes through the tensioning take up means including the bars 5, 51 and 52 in which variations in the feeding speed relative to the cutting device or other means (not shown) are compensated wherein the prestretching of the tow that is desirable for cutting may take place.

The invention is illustrated where the rotator is in the form of a ring or a disc. Of course, the plucking can occur with the help of a device in which the cams or combs are positioned on a moving chain. This device has the advantage that the plucking occurs over the whole width of the filament tows in the same direction. The track of the chain may run at a right angle or in any desired angle across the filament tow. It is equally possible as with the rotator, to activate the chain in both directions to the filament or in just one direction in which the return of the chain occurs at such a distance from the filament cable that the cams do not touch it.

If desired, the same effect can be achieved by tilting the rotator.

While a preferred embodiment of the invention has been described using specific terms, such description is for illustrative purposes only, and it is to be understood that changes and variations may be made without departing from the spirit or scope of the following claims.

What is claimed is:

1. The method of loosening and spreading the filaments of a tow comprising guiding the tow to a tensioning zone, applying tension to the filaments of the tow while advancing same in said zone, and exerting a plucking force on said tow by successively moving inclined profiles from one side of the tow to the other across the filaments thereof as said tow is advanced in said zone.

2. The method set forth in claim 1, wherein said plucking force is exerted intermittently.

3. The method set forth in claim 1, wherein said plucking force is applied in a transverse direction in a first portion of the tensioning zone and in an opposite direction in a second portion of the tensioning zone.

4. Apparatus for loosening and spreading the filaments of a tow comprising, spaced tensioning means forming a tensioning zone for receiving and advancing said tow under predetermined tension and plucking means positioned between said tensioning means movable across said tow in engagement with the filaments thereof said plucking means including a plurality of inclined profiles and means for successively moving said profiles from one side of said tow to the other side as said tow is advanced in said zone.

5. The structure set forth in claim 4, wherein said means includes a rotor with said inclined profile being spaced thereon and extending therefrom into engagement with said tow.

6. The structure set forth in claim 5, wherein said profiles comprise combs that are tilted opposite a direction of rotation of the rotor.

* * * * *